US007909639B2

(12) United States Patent
Hirata et al.

(10) Patent No.: US 7,909,639 B2
(45) Date of Patent: Mar. 22, 2011

(54) ELECTRICAL CONNECTOR FOR FLAT CABLE

(75) Inventors: Hideyuki Hirata, Yamato (JP); Hiroshi Shimoyama, Isehara (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/087,144

(22) PCT Filed: Dec. 27, 2006

(86) PCT No.: PCT/US2006/049342

§ 371 (c)(1),
(2), (4) Date: Jan. 22, 2009

(87) PCT Pub. No.: WO2007/076148

PCT Pub. Date: Jul. 5, 2007

(65) Prior Publication Data

US 2009/0221178 A1 Sep. 3, 2009

(51) Int. Cl.
*H01R 12/24* (2006.01)

(52) U.S. Cl. ..... 439/495

(58) Field of Classification Search ..... 439/497, 439/495, 260, 67, 496, 77, 492, 499
See application file for complete search history.

(56) References Cited

U.S. PATENT DOCUMENTS 6,733,326 B2 * 5/2004 Lee ..... 439/495
2003/0220013 A1 11/2003 Lee

OTHER PUBLICATIONS

International Search Report for PCT/US2006/049342.

* cited by examiner

*Primary Examiner* — Javaid Nasri
(74) *Attorney, Agent, or Firm* — Timothy M. Morella

(57) ABSTRACT

An electrical connector for a flat sheet-like cable includes an insulative housing with a plurality of terminals and an actuator. The actuator is moveable between a first insertion position and a second operational position, the first position permitting insertion of the cable into the connector and the second position configured such that the contact pads of the cable engage the contact portions of the terminals. The actuator has an abutting part formed on opposite ends thereof. A pair of generally planar securing members is provided at opposite ends of the housing. Each securing member includes a stop surface to define a depth to which the cable may be inserted, a restraining member that interacts with the abutting parts upon positioning the actuator in the second position to define a restraining surface to prevent removal of the cable, and a recess portion defined between the stop surface and the restraining surface.

13 Claims, 5 Drawing Sheets

ELECTRICAL CONNECTOR FOR FLAT CABLE

BACKGROUND OF THE INVENTION

1. Field of the Invention

The present invention relates to a connector for cable connection.

2. Description of the Related Art

Conventionally, a connector for cable connection, such as an FPC connector or an FFC connector, has been used for connecting a flexible flat sheet-like cable, such as one called as a flexible printed circuit (FPC) or a flexible flat cable (FFC), (for example, refer to Japanese Utility Model Registration Publication No. 2574041). The connector for cable connection is provided with auxiliary connector securing members, disposed at opposite ends of an opening through which a flat sheet-like cable is inserted.

FIG. 5 is a perspective view showing a major part of an auxiliary connector securing member in a conventional connector for cable connection.

The conventional connector for cable connection has a housing formed of an insulating material such as synthetic resin, and a plurality of terminals that are formed of a conductor material, such as metal, and are secured by the housing. Auxiliary connector securing members 301 are fixed to opposite ends of an opening. Further, an actuator formed of an insulating material such as synthetic resin is rotatably secured to the opening, allowing the actuator to rotatably secured to the opening, allowing the actuator to rotate between its open position and its close position. A flat sheet-like cable is inserted into the opening in the open position of the actuator, and on completion of the insertion of the cable, the actuator is operated to rotate to its close position by the manual operation by an operator, so that the flat sheet-like cable is locked. Thus, a plurality of conductor lines contained in the cable are brought into contact with the corresponding terminals, thereby completing the connection of the cable to the cable connecting connector.

As shown in FIG. 5, the auxiliary connector securing member 301 has, at a portion corresponding to the end of the opening on the near side, a projecting part 302 for preventing a cable from being pulled out, and a restraining part 303 for restraining the cable from rotating. The restraining part 303 is formed by bending an end portion of a body part so as to have a U-shape in a plane, and the projecting part 302 is formed so as to project inwardly of the opening at a right angle with respect to the body part. The reference number 304 designates a fixing part to be fixed to a substrate by soldering, which is formed so as to project outwardly of the opening at a right angle with respect to the body part. The reference number 305 designates an engaging part to be engaged with the housing.

On the other hand, a reinforcing plate is stuck to a lengthwise end of the cable. With the cable inserted and locked in the opening of the connector for cable connection, a lug-shaped projecting part projecting from a side of the reinforcing plate is positioned below the restraining part 303. Therefore, the projecting part of the reinforcing plate abuts against the restraining part 303 thereby to prevent the rotation of the cable with respect to the cable connector. Moreover, the projecting part of the reinforcing plate abuts against the projecting part 302 thereby to prevent the cable from being pulled out of the cable connector.

Nevertheless, in the above-described conventional connector for cable connection, since the projecting part of the reinforcing plate of the cable inserted into the opening is positioned below the restraining part 303, an operator becomes incapable of visually confirming the position of the projecting part. For this reason, the operator may operate the actuator and lock the cable, failing to realize the fact that the cable is not inserted into the innermost end of the opening, or the cable is inserted obliquely, namely, the incomplete insertion of the cable. This results in no contact between the conductor lines of the cable and the terminals of the connector for cable connection, providing no electric connection between the two. Especially, since a connector for cable connection is presently miniaturized, the length of a contact portion in the conductor line of a cable and the length of a contact portion of the terminal of a connector for cable connection are extremely short. Consequently, any minor incomplete state of insertion of the cable can increase the danger of failure of contact between the conductor lines and the terminals.

In addition, the auxiliary connector securing members 301 of the above-mentioned conventional cable connecting connector is provided with the projecting part 302, the restraining part 303, the fixing part 304, and the engaging part 305, resulting in a complicated structure. This may raise the cost of the auxiliary connector securing member 301, and makes it difficult to carry out the assembling work of the auxiliary connector securing member 301 to the cable connecting connector, thus raising the total cost of the cable connecting connector.

SUMMARY OF THE INVENTION

The object of the present invention is to solve the above-mentioned problems encountered by the conventional connector for cable connection, by providing a connector for cable connection in which lug parts projecting from opposite sides of the flat sheet-like cable are fitted in recess portions formed in flat sheet-like auxiliary connector securing members, so that it has a simple structure and yet it enables visual check whether a flat sheet-like cable is inserted in its complete state, easy manufacturing and fixing of the auxiliary connector securing members, and reliable connection of the flat sheet-like cable without the danger of disengagement thereof.

To this end, a connector for cable connection, of the present invention, includes a housing having an inserting hole formed therein through which a flat cable is inserted; terminals attached to the housing and having contact portions electrically connected to conductor lines often used as signal lines of the flat sheet-like cable; an actuator being able to change its attitude between a first position to permit insertion of the flat sheet-like cable and a second position to bring conductor lines of the inserted flat sheet-like cable into contact with the contact portions, the actuator having a body part which is substantially parallel to a direction of insertion of the flat sheet-like cable at the second position, and abutting parts formed on opposite sides of the body part; a flat sheet-like auxiliary connector securing members attached to opposite sides of the housing; the flat sheet-like cable having lug parts projecting from opposite sides thereof; and the auxiliary connector securing member having a supporting surface, against which the abutting part abuts at the second position, and a fitting recess portion opening into the supporting surface, into which the lug part is fit.

In the connector for cable connection according to another embodiment of the present invention, the fitting recess portion is arranged in such a position that the lug part can be fitted in the fitting recess portion when the flat sheet-like cable inserted into the inserting hole reaches a position where all the conductor lines of the flat sheet-like cable are electrically connected with corresponding contact portions of the terminals.

In the connector for cable connection according to a still other embodiment of the present invention, the actuator has a lug holding part formed outside of the abutting part and abutting against the lug part fitted in the fitting recess portion at the second position.

In the connector for cable connection according to a still other embodiment of the present invention, the abutting part closes off the fitting recess portion at the second position.

In the connector for cable connection according to a still other embodiment of the present invention, the housing has a first locking portion, and the actuator has a second locking portion for locking the actuator by engagement with the first locking portion at the second position.

In the connector for cable connection according to a still other embodiment of the present invention, the fitting recess portion has a restraining surface opposed to one end of the fitted lug part, a recessed surface opposed to the other end of the lug part, and an upper end projecting part being above and adjacent to the recessed surface and projecting toward the restraining surface, an upper surface of the upper end projecting part being contained in the supporting surface.

In the connector for cable connection according to a still other embodiment of the present invention, the restraining surface abuts against one end of the lug part thereby to inhibit displacement in a reverse direction of a direction of insertion of the flat cable.

In the connector for cable connection according to a still other embodiment of the present invention, the fitting recess portion has a bottom surface opposed to a downwardly directed surface of the fitted lug part, and a storage recess portion recessed downwardly from the bottom surface, and the storage recess portion is in a position in the vicinity of a substrate securing part in the auxiliary connector securing member to be soldered.

In accordance with the present invention, the connector for cable connection is configured so that the lug parts projecting from opposite sides of a flat sheet-like cable is received within the recess portions formed in the flat auxiliary connector securing members. This simple structure enables visual check whether a flat sheet-like cable is inserted in its complete state, easy manufacturing and fixing of the auxiliary connector securing members, and reliable connection of the flat sheet-like cable without the danger of disengagement thereof.

An electrical connector for a flat sheet-like cable includes an insulative housing with a plurality of terminals and an actuator. The actuator is moveable between a first insertion position and a second operational position with the first position permitting insertion of the cable into the connector and the second position being configured such that the contact pads of the cable engage the contact portions of the terminals. The actuator has an abutting part formed on opposite ends thereof. A pair of generally planar securing members is provided at opposite ends of the housing. Each securing member includes a stop surface to define a depth to which the cable may be inserted, a restraining member that interacts with said abutting part of said actuator upon positioning said actuator in the second position to define a restraining surface to prevent removal of said cable and a recess portion defined between the stop surface and said restraining surface.

BRIEF DESCRIPTION OF THE DRAWINGS

Other objects and advantages of the present invention will be understood from the following description according to one preferred embodiment of the present invention which is shown in accompanying drawings in which.

DESCRIPTION OF THE PREFERRED EMBODIMENTS

Preferred embodiments of the present invention will now be described in detail with reference to the accompanying drawings.

Figure 1:
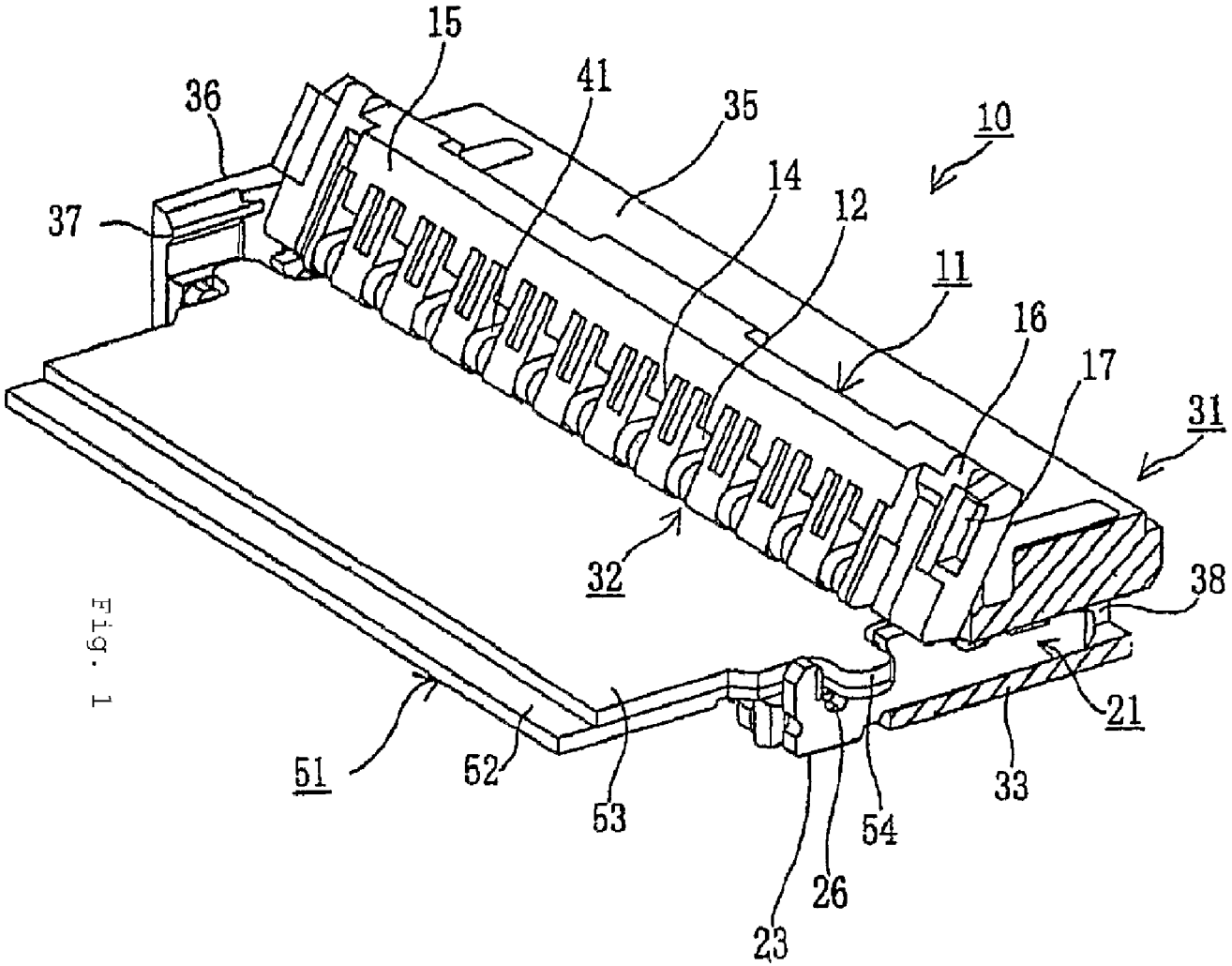
FIG. 1 is a first perspective view illustrating a connector for cable connection in a preferred embodiment of the present invention.

In FIG. 1, the reference numeral 10 designates a connector for cable connection in the preferred embodiment, which is mounted on a substrate such as a printed circuit board (not shown), and used to electrically connect a flat sheet-like cable 51 called as a flexible printed circuit, a flexible flat cable, or the like. In the preferred embodiment, it should be appreciated that the expressions indicating the directions, such as up, down, left, right, front, and rear, which are used to describe the constructions and operations of the parts of the connector 10 and the flat sheet-like cable 51, are relative rather than absolute. These expressions are appropriate when the connector 10 and the flat sheet-like cable 51 are in the attitudes as shown in the drawings, but when the attitudes of the connector 10 and the flat sheet-like cable 51 are changed, these expressions shall be interpreted according to the change in attitude.

The flat sheet-like cable 51 is suitable for use in a narrow mounting space, for example, a liquid crystal display or a plasma display. The flat sheet-like cable 51 has an elongated strip-shaped cable body 52 provided with conductor lines or contact pads (not shown). In the interior of the cable body 52, a plurality of, for example, about ten, conductor lines formed of a conductive metal in the shape of a foil extending lengthwise of the cable body 52 are arranged in parallel at a predetermined pitch, for example, about 0.5 mm. The number and the pitch of the conductor lines may be changed suitably. The conductor lines are covered so as to be sandwiched from both of upper and lower surfaces by film-shaped insulating layers exhibiting electronic insulating property.

Further, a reinforcing plate 53 is stuck to one of surfaces of the lengthwise end of the cable body 52, and the conductor lines are exposed at one of the surfaces on the opposite side of the reinforcing plate 53 in the lengthwise end of the cable body 52. The reinforcing plate 53 is formed of material having a relatively high hardness, such as polyimide, and covers one surface of the lengthwise end of the cable body 52, in a predetermined range in the lengthwise direction and in the entire range in the widthwise direction. The cable body 52 is designed to be inserted into an inserting hole 32 of the connector 10, with the surface having the exposed conductor lines facing down as viewed in FIGS. 1 to 3.

Lug parts or projections 54 projecting laterally from opposite sides or edges of the flat sheet-like cable 51 in the direction of width of the flat sheet-like cable 51 are formed in the vicinity of the front end of the flat sheet-like cable 51 in the direction of length of the flat cable 51. The lug parts 54 are arranged a predetermined distance away from the front edge of the flat sheet-like cable 51 in the direction of length of the flat cable 51. Although the lug parts 54 are formed in the cable body 52 and the reinforcing plate 53, they may be formed only in the reinforcing plate 53. In the alternative, the cable may be rectangular and include openings or recesses that engage the connector 10.

Figure 2:
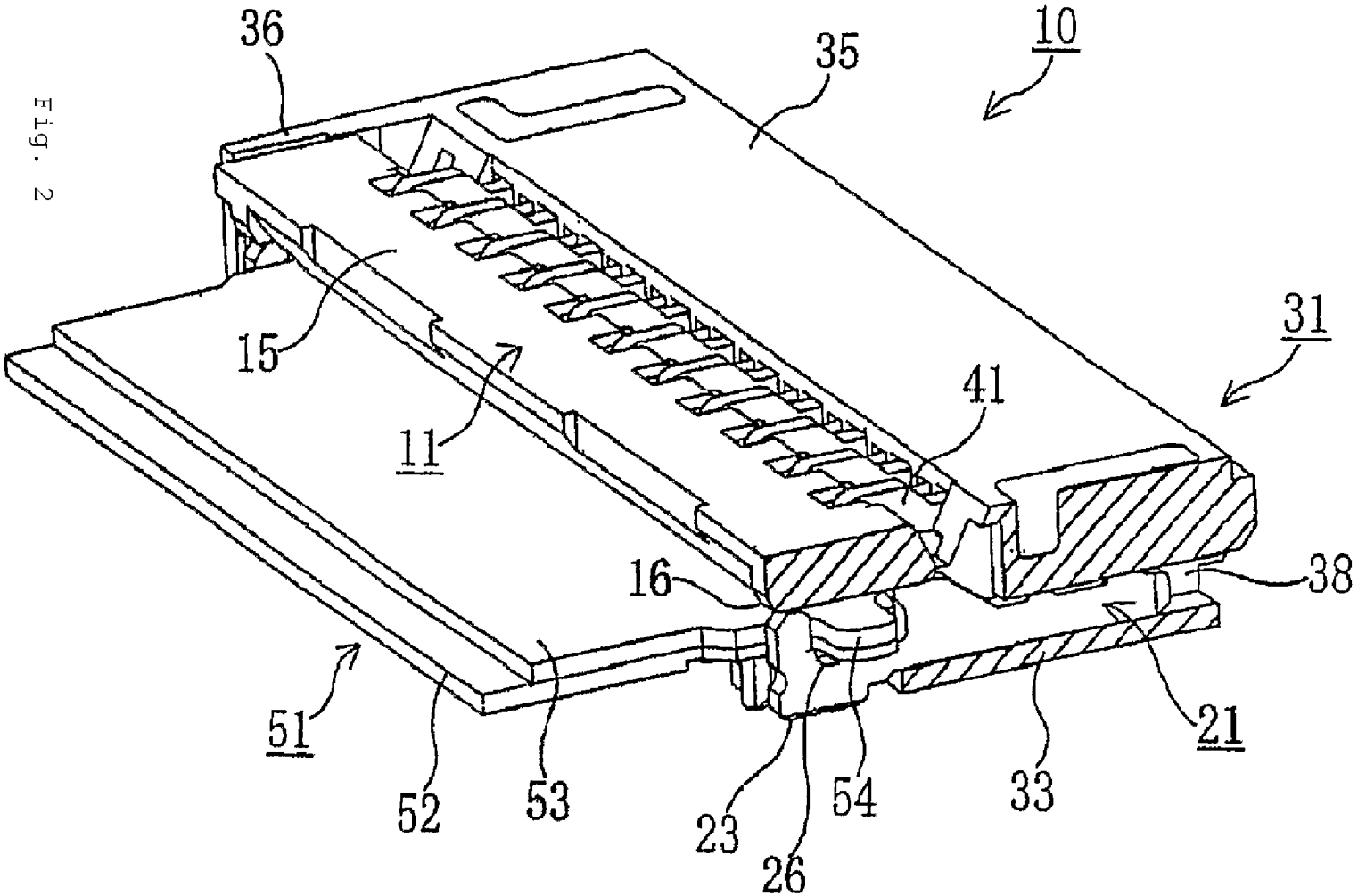
FIG. 2 is a second perspective view illustrating the connector for cable connection in the preferred embodiment of the present invention.
Figure 3:
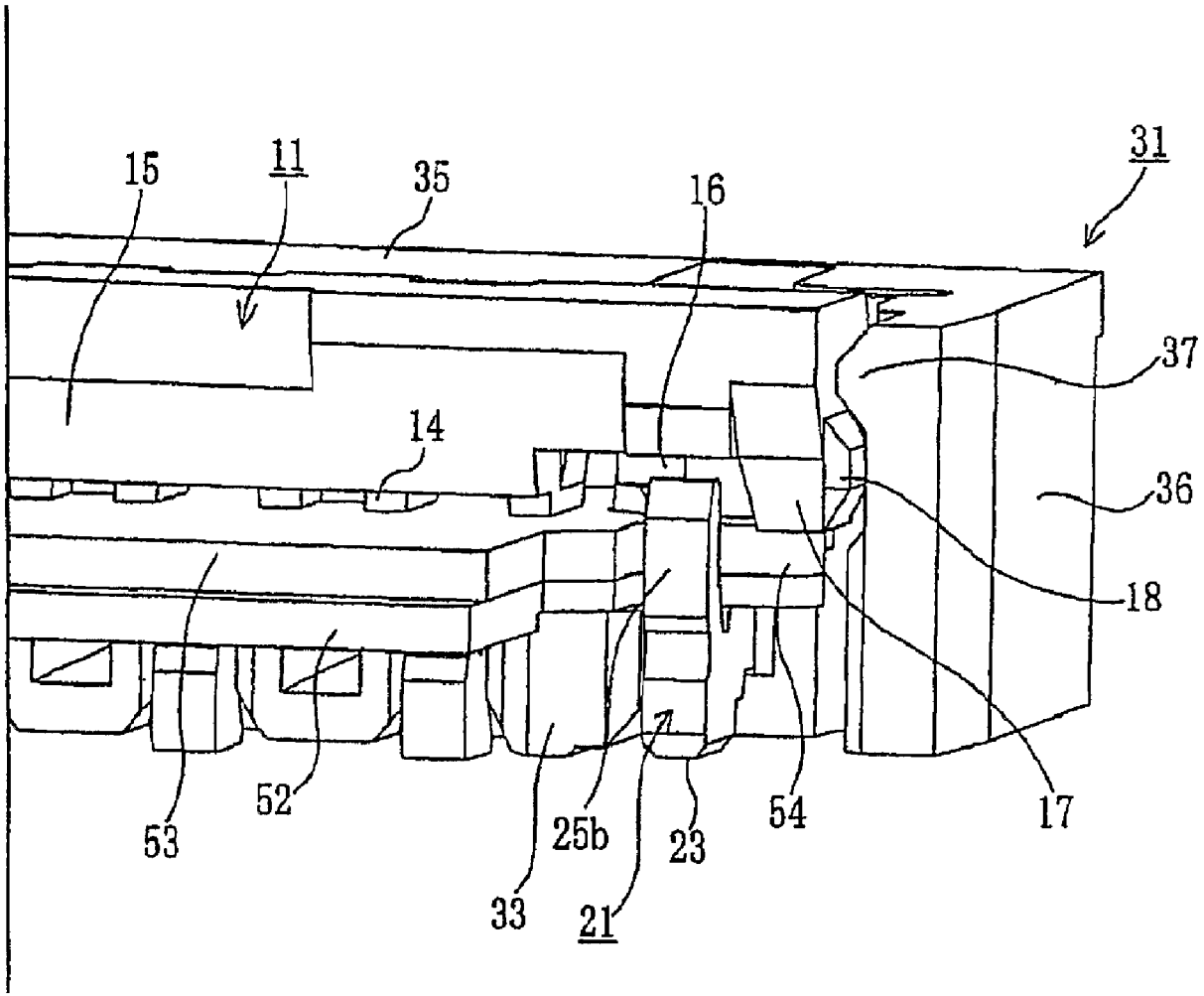
FIG. 3 is an enlarged perspective view illustrating a major part of the connector for cable connection in the preferred embodiment of the present invention.

The connector 10 has a housing 31 as a connector body integrally formed by an insulating material such as synthetic resin, and an actuator 11 as a movable member for fixing a cable, which is integrally formed by an insulating material such as synthetic resin, and attached to the housing 31 so that it is able to change its attitude. Specifically, the actuator 11 is disposed in the housing 31 so that it can move, by its attitude change, from an open or insertion position as a first position as shown in FIG. 1, and a closed position as a second operational position as shown in FIGS. 2 and 3. For the clarity of describing the invention, FIGS. 1 and 2 illustrate a state in which the widthwise one end portion of the housing 31 and the actuator 11 is cut away.

The housing 31 also has a lower part 33, an upper part 35, right and left side parts 36, and an inserting hole 32 formed between the lower part 33 and the upper part 35, and between the side parts 36, as an opening through which an end of the flat sheet-like cable 51 is inserted from the front (the left as viewed in FIGS. 1 and 2). A housing side locking portion 37 as a first locking portion projecting inwardly is formed on the inner side surface of the side part 36. In FIGS. 1 to 3, the end of the inserted flat sheet-like cable 51 closes off the inserting hole 32. The flat sheet-like cable 51 is inserted toward the rear (the right as viewed in FIGS. 1 and 2).

The housing 31 has a plurality of terminal receiving grooves (not shown) formed therein, into which metallic terminals 41 are loaded. For example, about ten terminal receiving grooves are formed at approximately 0.5 mm pitch, and the terminals 41 are loaded one by one into the terminal receiving grooves. The pitch and the number of the terminal receiving grooves may be changed arbitrarily as required. The terminals 41 are not necessarily required to be loaded into all of the terminal receiving grooves, but some of the terminals 41 may be omitted suitably depending upon the array of the conductor lines of the flat sheet-like cable 51.

The terminal 41 has an upper arm beam extending in the direction of insertion of the flat sheet-like cable 51, a lower arm beam extending in parallel with the upper arm beam, and a tale part connected by soldering to a wiring (not shown) in the substrate surface. The upper arm beam extends to just above a second shank of the actuator 11, described later, and limits upward movement of the second shank. A contact portion projecting upwardly from the bottom surface (not shown) of the inserting hole 32 is formed at the tip of the lower arm beam, so that the contact portion can contact the corresponding conductor line of the flat sheet-like cable 51, thereby establishing electrical conduction between the conductor line and the terminal 41. In the predetermined range in the lengthwise direction of the conductor line which comes in contact with the contact portion of the terminal 41, namely, in the contact range, the lower insulating layer is stripped and the conductor line is exposed.

Further, auxiliary securing member receiving recess portions 38 in the shape of a slit extending in a direction of insertion of the flat sheet-like cable 51 are formed in the housing 31 at locations on the opposite sides of the lower part 36 and in the vicinity of the side parts 36, and auxiliary connector securing members 21, called "fitting or solder nails," are inserted in the auxiliary securing member receiving recess portions 38, thereby the latter is secured to the housing 31.

Figure 4:
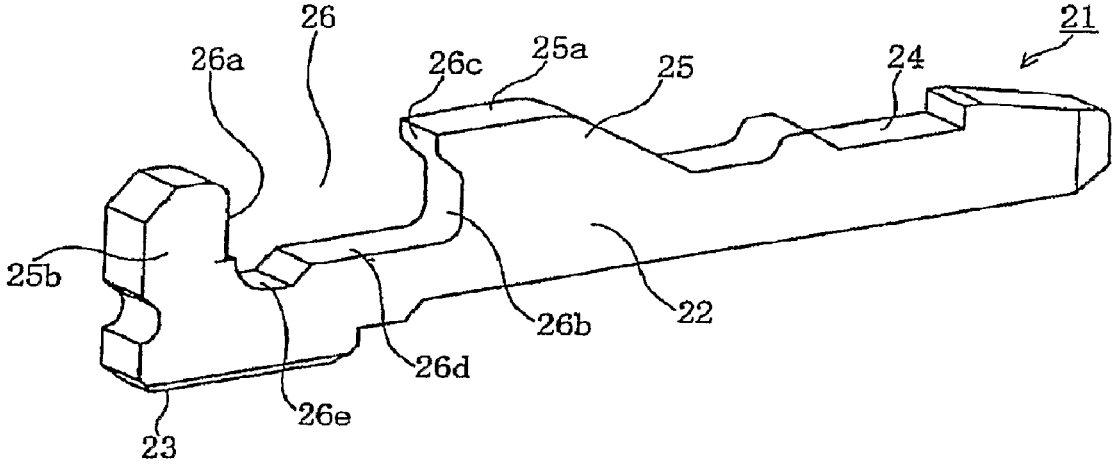
FIG. 4 is a perspective view illustrating an auxiliary connector securing member in the preferred embodiment of the present invention.
Figure 5:
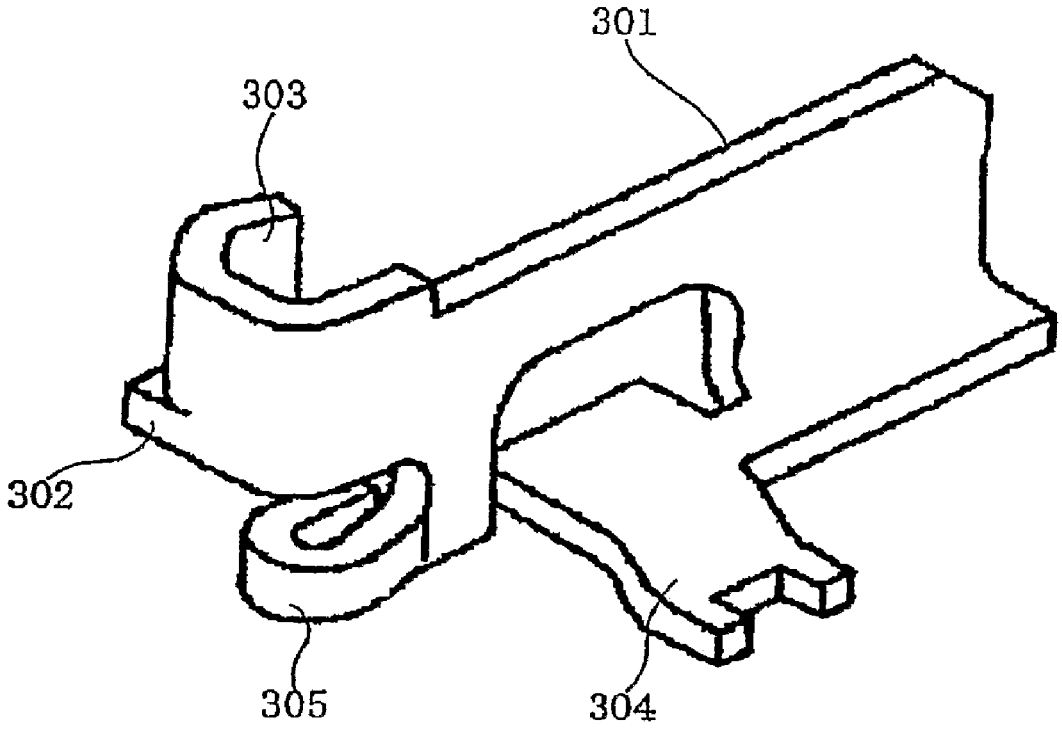
Fig. 5 (Prior art)
FIG. 5 is a perspective view showing a major part of an auxiliary connector securing member of a conventional connector for cable connection.

Referring to FIG. 4, the auxiliary connector securing member 21 is a flat plate-like, planar metallic member integrally formed as a unit by applying a manufacturing process such as stamping, to a metallic plate member. The auxiliary connector securing member 21 comprises a metallic body part 22 in the shape of an elongated plate to be inserted into the auxiliary securing member receiving recess portion 38, a substrate securing part 23 projecting downwardly at the rear end of the metallic body part 22 (the left end as viewed in FIG. 4), an engaging part 24 formed on the upper surface of the front of the metallic body part 22 (the right as viewed in FIG. 4) and having recessed and protruded portions formed therein to engage with the housing 31, a supporting part 25 projecting upward at the rear of the metallic body part 22, and a fitting recess portion 26 formed in the supporting part 25 to be fitted into the lug part 54 of the flat sheet-like cable 51.

By fixing the substrate securing part 23 to the surface of the substrate by soldering or the like, the auxiliary connector securing member 21 exhibits the function of securing the connector 10 to the substrate. The supporting part 25 has an upwardly facing supporting surface 25*a*, which abuts against the abutting part 16 of the actuator 11 in the closes position, thereby to support the actuator 11. The supporting part 25 is divided in the lengthwise direction by the fitting recess portion 26 opening into the supporting surface 25*a*, and has a restraining part 25*b* generated by this division. The restraining part 25*b* projects upwardly at the rear end of the metallic body part 22, and engages with the lug part 54 of the flat sheet-like cable 51 fitted into the fitting recess portion 26, thereby preventing disengagement of the flat sheet-like cable 51. The upper end surface of the restraining part 25*b* is flush with the supporting surface 25*a*, and abuts against the abutting part 16 of the actuator 11 in its close position, thereby supporting the actuator 11.

The fitting recess portion 26 has a restraining surface 26*a* opposed to the rear end of the lug part 54 of the flat sheet-like cable 51 fitted into the fitting recess portion 26, a recessed or stop surface 26*b* opposed to the front end of the lug part 54, an upper end projecting part 26*c* being above and adjacent to the recessed surface 26*b* and projecting rearward from the supporting part 25, a generally linear bottom surface 26*d* opposed to a downward surface of the lug part 54 of the flat sheet-like cable 51 fitted into the fitting recess portion 26, and a storage recess portion 26*e* that is recessed downwardly from the bottom surface 26*d* in the vicinity of the front end.

The position where the fitting recess portions 26 are formed is, as shown in FIG. 1, a position where the lug parts 54 on opposite sides can be fitted into the fitting recess portions 26 of the auxiliary connector securing members 21 secured to the opposite sides of the housing 31 when the flat sheet-like cable 51 is inserted in its complete state into the inserting hole 32 of the connector 10, namely, when the flat sheet-like cable 51 is inserted to reach such a position that the front end of the flat sheet-like cable 51 reaches the innermost end of the inserting hole 32, and the flat sheet-like cable 51 is not obliquely inserted so that the contact range of all conductor lines of the flat sheet-like cable 51 reliably contact the corresponding contact portions of the terminals 41.

The dimension of the fitting recess portion 26 in the back-and-forth direction, namely, the distance from the restraining surface 26*a* to the recessed surface 26*b* is set to be equal to or slightly longer than the dimension of the lug part 54 with respect to the lengthwise direction of the flat sheet-like cable 51, namely, in the back-and-forth dimension of the lug part 54. The dimension of the fitting recess portion 26 in the height direction, namely, the distance from the opened end of the fitting recess portion 26 to the bottom surface 26*d* is set to be slightly longer than the dimension of the lug part 54 in the thickness direction. The dimension at the opened end of the fitting recess portion 26 in the back-and-forth direction, namely, the distance from the restraining surface 26*a* to the upper end projecting part 26*c* is shorter than the dimension of the lug part 54 in the back-and-forth direction. Hence, even if the back-and-forth dimension of the entire auxiliary connector securing member 21 and the back-and-forth dimension of the supporting part 25 are decreased to decrease the back-and-forth dimension of the connector 10 in accordance with the demand of miniaturization, the upper surface of the upper end projecting part 26*c* is contained in the supporting surface 25*a*, allowing the back-and-forth dimension of the supporting surface 25*a* to be increased, and as a result, the actuator 11 in its close position can be supported stably. Since the lug part 54 allows for slight deformation, even though the back-and-forth dimension at the opened end of the fitting recess portion 26 is small, the lug part 54 can be fitted into the fitting recess portion 26 by having the lug part 54 to be deformed when it is passed through the opened end.

If the flat sheet-like cable 51 is subject to force in the direction in reverse to the direction of insertion into the inserting hole 32, namely, the force by which the flat cable 51 can be disengaged from the connector 10, the restraining surface 26*a* abuts against the rear end of the lug part 54 of the flat sheet-like cable 51 fitted into the fitting recess portion 26, thereby preventing the flat sheet-like cable 51 from being displaced in the direction in reverse to the direction of insertion of the flat sheet-like cable 51. That is, the restraining surface 26*a* functions as a stopper surface for preventing disengagement of the flat sheet-lie cable 51. The restraining part 25*b* functions as a stopper part for preventing disengagement of the flat sheet-like cable 51, and it will receive the force by which the flat sheet-like cable 51 can be disengaged from the connector 10. Although the restraining part 25*b* is small in the back-and-forth dimension, it is integrally formed with the metallic body part 22 which is a flat plate-like metallic member, and therefore exhibits sufficiently high strength. This eliminates the danger of deformation under the above-mentioned force.

Further, when the substrate securing part 23 is fixed to the surface of the substrate by soldering, there may occur the phenomenon that melted solder may rise along the side surfaces of the substrate securing part 23 and the metallic body part 22, which is called "solder wicking." In the case wherein the "wicked" solder enters into the fitting recess portion 26 and adheres to and solidifies along the restraining surface 26*a*, the recessed surface 26*b*, or the bottom surface 26*d*, the dimension of the fitting recess portion 26 will become smaller, and may fail to allow the lug part 54 to fit therein. Accordingly, in the present embodiment, the storage recess portion 26*e* is shown as being formed at a position in the vicinity of the substrate securing part 23 in the bottom surface 26*d*. Therefore, if the phenomenon of solder wicking occurs, the solder can be stored in the storage recess portion 26*e*, so that it is less likely to adhere to the restraining surface 26*a*, the recess surface 26*b*, or the bottom surface 26*d*.

The actuator 11 has on the lower surface of the body part 15 a plurality of pressing parts 14, by which, when the actuator 11 is in its close position, the flat sheet-like cable 51 inserted through the inserting hole 32 is pressed downwardly, namely, in the vicinity of the lower arm beam of each terminal 41 loaded in the terminal receiving groove. When the actuator 11 is in its open position, the pressing parts 14 permit insertion of the flat sheet-like cable 51. Formed between the pressing parts 14 are a plurality of holding grooves 12 for holding the upper arm beams of the terminals 41. The number and the position of the holding grooves 12 correspond to those of the terminal receiving grooves. When the actuator 11 is in its close position, the body part 15 is almost parallel with the direction of insertion of the flat sheet-like cable 51 as shown in FIG. 2. When the actuator 11 is in its open position, the body part 15 is located at 90° or more with respect to the direction of insertion of the flat sheet-like cable 51 as shown in FIG. 1.

The lower ends, as viewed in FIG. 1, of the abutting parts 16 formed on opposite sides of the actuator 11 abut against the supporting surfaces 25*a* of the supporting parts 25 of the auxiliary connector securing members 21 and supported from below and thus function as first shanks, when the actuator 11 changes its attitude from its open position to its close position. A second shank (not shown) is formed in each of the holding grooves 12 of the actuator 11. Although the first shank and the second shank are located nearly on a common line, the axis of the first shank and that of the second shank are not necessarily required to be aligned with each other, and they may be shifted from each other within a predetermined range. The upper arm beam of each terminal 41 is located just above the second shank, and the upward movement of the second shank is limited by the upper arm beam. Accordingly, the upper arm beam prevents the actuator 11 from being withdrawn from the housing 31.

The actuator 11 is further provided with lug holding parts 17 formed on further outside of the opposite abutting parts 16. As shown in FIG. 3, the lug holding part 17 abuts against the upper surface of the lug part 54 when the actuator 11 is in its close position. Therefore, even if the lug part 54 is subject to upward force by the force applied to the flat sheet-like cable 51, the lug part 54 may not displace upward, and so the function of the lug parts 54 and the auxiliary connector securing members 21 to prevent disengagement of the flat sheet-like cable 51 against the force causing the flat sheet-like cable 51 to disengage from the connector 10 is enhanced.

Moreover, an actuator side locking portion 18 as a second locking portion projecting outwardly is formed on the outer side surface of the lug holding part 17. As shown in FIG. 3, when the actuator 11 is in its close position, the actuator side locking portion 18 is engaged with the housing side locking portion 37 of the housing 31. Thus, the actuator 11 is locked in its close position, and does not return to its open position even under external force such as vibration or shock.

The following is the explanation of the operation of the connector 10 having the above-mentioned construction. Here, the operation of connecting the flat sheet-like cable 51 to the connector 10 will be discussed.

In the present embodiment, the connector 10 is mounted on a substrate such as a circuit board, by connecting the tale parts of terminals 41 to the wiring formed on the surface of the substrate by soldering, and connecting the substrate securing parts 23 of the auxiliary connector securing members 21 to the connecting pads formed on the surface of the substrate by soldering.

In the case where the flat sheet-like cable 51 is connected to the connector 10, firstly, the end of the flat cable 51 in the lengthwise direction is inserted into the inserting hole 32 of the housing 31. At this time, as shown in FIG. 1, the actuator 11 is brought into its open position in advance. With the flat sheet-like cable 51 tilted with respect to the upper surface (not shown) of the lower part 33 of the housing 31, an operator moves the end of the flat sheet-like cable 51 in the lengthwise direction from obliquely above the housing 31 into the inserting hole 32. This facilitates insertion of the lengthwise end of the flat sheet-like cable 51 into the inserting hole 32, rather than the case of moving the flat sheet-like cable 51 in parallel with the upper surface of the lower part 33. The flat sheet-like cable 51 is moved, with the reinforcing plate 53 facing up, and with the surface of the cable body 52 where the conductor lines are exposed facing down.

At this time, opposite side end portions of the flat sheet-like cable 51 ahead of the lug parts 54 are guided by the inner side surfaces of the auxiliary connector securing members 21 secured to the opposite sides of the housing 31. Consequently, the flat sheet-like cable 51 can be inserted into the inserting hole 32 in the state in which it is accurately positioned in the widthwise direction, and the position of each conductor line, with respect to the widthwise direction of the flat sheet-like cable 51, is a position corresponding to the lower arm beam of a corresponding terminal 41. When the flat sheet-like cable 51 is inserted into the innermost end, the lug parts 54 on opposite sides are fitted into the fitting recess portions 26 of the auxiliary connector securing members 21 secured to opposite sides of the housing 31, resulting in the state as shown in FIG. 1.

As above described, the position where the fitting recess portion 26 is formed is a position where the lug parts 54 on opposite sides can fit into the fitting recess portions 26 of the auxiliary connector securing members 21 secured to opposite sides of the housing 31 when the flat sheet-like cable 51 is inserted in its complete state into the inserting hole 32 of the connector 10. Therefore, by a visual check whether the lug parts 54 on opposite sides are fitted into the fitting recess portions 26 of the auxiliary connector securing members 21, as shown in FIG. 1, the operator can confirm that the front tip of the flat sheet-like cable 51 reaches the innermost end of the inserting holes 32, and the flat sheet-like cable 51 is inserted without tilting so that the contact range of every conductor line of the flat sheet-like cable 51 reliably contacts the contact portion of a corresponding terminal 41. In other words, a visual check whether the lug parts 54 on opposite sides are fitted into the fitting recess portions 26 of the connector securing members 21 enables the operator to judge whether or not the flat sheet-like cable 51 is inserted in its complete state into the inserting hole 32.

Subsequently, the operator urges the actuator 11 to change its attitude in the counterclockwise direction as viewed in FIG. 1, resulting in its close position as shown in FIG. 2. Hence, the pressing parts 14 rotate and face down, so that they are nearly parallel with the direction of insertion of the flat sheet-like cable 51. Then, the pressing parts 14 abut against the upper surface of the reinforcing plate 53 of the flat sheet-like cable 51, and then apply downward force to press the cable body 52 against the lower arm beams of the terminals 41. As a result, the contact ranges of the conductor lines exposed at the lower surface of the cable body 52 abut against the contact portions, and the conductor lines and the terminals 41 are electrically connected to each other, thus completing the connection of the flat sheet-like cable 51 to the connector 10. The lower arm beam has resilient property, and is elastically deformed under pressure applied to the cable body 52, so that the connection between the contact ranges of the conductor lines and the contact portions of the terminals 41 can be well maintained.

Additionally, when the actuator 11 is in its close position, the lower surface of the abutting part 16 is supported from below by abutting against the supporting surface 25*a* of the supporting part 25 of the auxiliary connector securing members 21 secured to the opposite sides of the housing 31 and the upper end surface of the restraining parts 25*b*. In this case, since the back-and-forth dimension of the supporting surface 25*a* is set long by forming the upper end projecting part 26*c*, the force received by the supporting surface 25*a* and the restraining part 25*b* in the abutting part 16 is dispersed widely, which eliminates the danger of deformation or damage of the abutting part 16. Hence, if the back-and-forth dimension of the entire auxiliary connector securing members 21 and the back-and-forth dimension of the supporting part 25 are decreased to decrease the back-and-forth dimension of the connector 10 in accordance with the demand of miniaturization, the actuator 11 in its close position can be stably supported by the supporting parts 25.

Additionally, when the actuator 11 is in its close position, the lower surface of the abutting part 16 closes off the opened end of the fitting recess portion 26 as shown in FIG. 2, and the lug holding part 17 abuts against the upper surface of the lug part 54 as shown in FIG. 3. Hence, if the lug part 54 is subjected to upward force by the force applied to the flat sheet-like cable 51, the lug part 54 may not displace upward. By this feature, against the force by which the flat sheet-like cable 51 can be disengaged from the connector 10, the function of the lug parts 54 and the auxiliary connector securing members 21 for preventing disengagement of the flat sheet-like cable 51 is enhanced.

Additionally, when the actuator 11 is in its close position, the actuator side locking portions 18 are engaged with the housing side locking portions 37 of the housing 31, as shown in FIG. 3. Therefore, the actuator 11 is locked in its close position, and does not return to its open position even under external force such as vibration or shock. This securely maintains the state in which the flat sheet-like cable 51 is connected to the connector 10. In the case where the lug parts 54 on opposite sides are not fitted into the fitting recess portions 26 of the auxiliary connector securing members 21, the actuator 11 does not take its close position. This eliminates the possibility of engagement between the actuator side locking portions 18 and the housing side locking portions 37. Accordingly, a visual check whether or not the actuator 11 is locked enables the operator to judge whether the flat sheet-like cable 51 is inserted in its complete state into the inserting hole 32.

Thus, in the present embodiment, the flat plate-like auxiliary connector securing members 21 secured to the opposite sides of the housing 31 of the connector 10 is provided with the supporting surface 25*a*, against which the abutting part 16 of the actuator 11 abuts in its close position, and the fitting recess portion 26 opening into the supporting surface 25*a*, into which the lug part 54 of the flat sheet-like cable 51 is fitted. Such a simple structure permits reliable prevention of disengagement of the flat sheet-like cable 51. Further, an operator can visually confirm that the flat sheet-like cable 51 has been inserted in its complete state, achieving reliable connection of the flat sheet-like cable 51. Furthermore, the auxiliary connector securing member 21 has a simple structure and thus facilitates its manufacturing and assembling work.

Additionally, the position of the fitting recess portion 26 is the position where the lug part 54 can fit into the fitting recess portion 26 when the flat sheet-like cable 51 inserted into the inserting hole 32 reaches the position where the contact range of every conductor line electrically contacts the contact portion of a corresponding terminal 41. Hence, a visual check whether or not the lug parts 54 are fitted into the fitting recess portions 26 enables an operator to easily confirm that the flat sheet-like cable 51 has been inserted in its complete state.

Additionally, when the actuator 11 is in its closed position, the lug holding part 17 abuts against the lug part 54 fitted into the fitting recess portion 26. The abutting part 16 closes off the fitting recess portion 26. This eliminates the danger of upward displacement of the lug parts 54, and thus ensures prevention of disengagement of the flat sheet-like cable 51 even under the force by which the flat sheet-like cable 51 can be disengaged from the connector 10.

Additionally, when the actuator 11 is in its closed position, the actuator side locking portion 18 is engaged with the housing side locking portion 37 of the housing 31. Thus, the actuator 11 is locked in its close position, and does not return to the open position even under external force such as vibration or shock. When each of the lug parts 54 is not fitted into the fitting recess portion 26, the actuator side locking portion 18 cannot be engaged with the housing side locking portion 37. A visual check whether or not the actuator side locking portion 18 is engaged with the housing side locking portion 37 allows for ease in judgment about whether the flat sheet-like cable 51 is inserted in its complete state.

In addition, the upper surface of the upper end projecting part 26*c* of the fitting recess portion 26 is contained in the supporting surface 25*a* of the supporting part 25. Hence, if the back-and-forth dimension of the entire auxiliary connector securing member 21 and the back-and-forth dimension of the supporting part 25 are decreased to decrease the back-and-forth dimension of the connector 10 in accordance with the demand of miniaturization, the upper surface of the upper end projecting part 26*c* is contained in the supporting surface 25*a* thereby to elongate the back-and-forth dimension of the supporting surface 25*a*. This enables the actuator 11 in its close position to be stably supported.

In addition, the fitting recess portion 26 has the storage recess portion 26*e* recessed downwardly than the bottom surface 26*d*. The storage recess portion 26*e* is in a position in the vicinity of the substrate securing part 23 to be soldered. Therefore, if the phenomenon of solder rise occurs and the risen solder enters into the fitting recess portion 26, the storage recess portion 26*e* can store the solder, thereby eliminating the danger of adhesion of the solder to the restraining surface 26*a*, the recess surface 26*b*, or the bottom surface 26*d*.

It is to be understood that the present invention is not limited to the foregoing preferred embodiment but it is susceptible of various changes and modifications based on the concept of the present invention, which may be considered as coming within the scope of the present invention.

What is claimed is:

1. An electrical connector for connection to a flat cable, the flat cable having an end portion with plurality of conductive contact pads and a projection extending from each opposite side edge thereof, the connector comprising:

an insulative housing, the insulative housing including a cable receiving opening into which the end portion may be inserted;

a plurality of terminals, each terminal being mounted on the insulative housing and having a contact portion configured for electrical connection to one of the conductive contact pads;

an actuator, the actuator being moveable between a first insertion position and a second operational position, the first insertion position permitting insertion of the cable into the connector and the second operational position being configured such that the conductive contact pads engage the contact portions of the terminals, the actuator including a body part, the body part being substantially parallel to a direction of insertion of the cable when the actuator is positioned at the second position, and an abutting part, the abutting part being formed on opposite ends of the body part; and a pair of generally planar securing members, each generally planar securing member being attached to an opposite end of the housing and including a stop surface, the stop surface defining a depth to which the flat cable may be inserted into the cable receiving opening, a restraining member, the restraining member interacting with the abutting part of the actuator upon positioning of the actuator in the second operational position to define a restraining surface to prevent removal of the flat cable, and a recess portion, the recess portion being defined between the stop surface and the restraining surface and into which the projection is positioned upon insertion of the flat cable into the connector and movement of the actuator to the second operational position;

wherein the positioning of the flat cable in the recess portion can be visually confirmed when the actuator is in the second operating position.

2. The electrical connector according to claim 1, wherein the actuator further includes projection holding parts, the projection holding parts being formed laterally outside of the abutting parts and abutting against the projections when the actuator is in the second operational position.

3. The electrical connector according to claim 2, wherein the insulative housing further includes a first locking portion, and the actuator further includes a second locking portion, the second locking portion locking the actuator at the second position by engagement between the first and second locking portions.

4. The electrical connector according to claim 1, wherein the insulative housing further includes a first locking portion, and the actuator further includes a second locking portion, the second locking portion locking the actuator at the second position by engagement between the first and second locking portions.

5. The electrical connector according to claim 1, wherein the restraining surface is positioned to oppose one end of the projection, and the stop surface is positioned to oppose the other end of the cable projection, and an upper end projecting part, the upper end projecting part being disposed above and adjacent to the recessed surface and projecting toward the restraining surface.

6. The electrical connector according to claim 5, wherein the recess portion further includes a generally linear bottom surface, the generally linear bottom surface being generally parallel to the insertion direction, and a storage recess portion, the storage recess portion being recessed downwardly from the bottom surface and disposed in a position proximate a solder tail portion of each generally planar securing members.

7. The electrical connector according to claim 6, wherein the insulative housing further includes a first locking portion, and the actuator further includes a second locking portion, the second locking portion locking the actuator at the second position by engagement between the first and second locking portions.

8. The electrical connector according to claim 1, wherein the generally planar securing members are generally perpendicular to the insertion direction of the flat cable.

9. An electrical connector for connection to a flat cable, the flat cable having an end portion with plurality of conductive contact pads, the connector comprising:

an insulative housing, the insulative housing including a cable receiving opening into which the end portion may be inserted;

a plurality of terminals, each terminal being mounted on the insulative housing and having a contact portion configured for electrical connection to one of the conductive contact pads;

an actuator, the actuator being moveable between a first insertion position and a second operational position, the first insertion position permitting insertion of the cable into the connector and the second operational position being configured such that the conductive contact pads engage the contact portions of the terminals, the actuator including an abutting part, the abutting part being formed on opposite ends thereof; and a pair of generally planar securing members, each generally planar securing member being attached to an opposite end of the housing and including a stop surface, the stop surface defining a depth to which the flat cable may be inserted into the cable receiving opening, a restraining member, the restraining member interacting with the abutting part of the actuator upon positioning of the actuator in the second operational position to define a restraining surface to prevent removal of the flat cable;

wherein the positioning of the flat cable in the restraining member can be visually confirmed when the actuator is in the second operating position.

10. The electrical connector according to claim 9, wherein the insulative housing further includes a first locking portion, and the actuator further includes a second locking portion, the second locking portion locking the actuator at the second position by engagement between the first and second locking portions.

11. The electrical connector according to claim 9, wherein each generally planar securing member includes a recess portion, the recess portion disposed between the stop surface and the restraining surface and including a generally linear bottom surface, the generally linear bottom surface being generally parallel to the insertion direction, and a storage recess portion, the storage recess portion being recessed downwardly from the bottom surface and disposed in a position in the vicinity of a solder tail portion of each generally planar securing members.

12. The electrical connector according to claim 11, wherein the insulative housing further includes a first locking portion, and the actuator further includes a second locking portion, the second locking portion locking the actuator at the second position by engagement between the first and second locking portions.

13. The electrical connector according to claim 9, wherein the generally planar securing members are generally perpendicular to the insertion direction of the flat cable.

* * * * *